US006955732B1

(12) United States Patent
Chan et al.

(10) Patent No.: US 6,955,732 B1
(45) Date of Patent: Oct. 18, 2005

(54) ADVANCED THERMOBARIC EXPLOSIVE COMPOSITIONS

(75) Inventors: May L. Chan, Ridgecrest, CA (US); Gary W. Meyers, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 90 days.

(21) Appl. No.: 10/779,545

(22) Filed: Feb. 11, 2004

Related U.S. Application Data

(62) Division of application No. 10/326,958, filed on Dec. 23, 2002.

(51) Int. Cl.[7] ..... C06B 25/34
(52) U.S. Cl. ..... 149/92
(58) Field of Search ..... 149/92

(56) References Cited

U.S. PATENT DOCUMENTS 3,804,683 A * 4/1974 Baldwin et al. ..... 149/19.5
5,750,921 A 5/1998 Chan et al.
5,996,501 A * 12/1999 Spencer et al. ..... 102/286
6,503,350 B2 * 1/2003 Martin et al. ..... 149/37

* cited by examiner

*Primary Examiner*—Aileen Felton
(74) *Attorney, Agent, or Firm*—Charlene A. Haley

(57) ABSTRACT

The invention disclosed herein relates to an explosive capable of enhanced combustion efficiently capable of sustaining a high pressure over a period of time in a confined environment, such as an air tight room or a cave, where oxygen may be in limited supply. An embodiment of the present invention is a metal composite that combines a binder, a reactive metal and an oxidizer. In another embodiment, a plasticizer and a catalyst are added. In another embodiment of the present invention, a solid fuel-air explosive (SFAE) having an annular construction is used. In a typical annular construction, a cylindrical shell of SFAE surrounds the cylindrically shaped high explosive. The SFAE includes at least one of reactive metal and metal composite. In addition, the metal composite is formed from at least one reactive metal, at least one binder and an oxidizer.

8 Claims, 1 Drawing Sheet

ADVANCED THERMOBARIC EXPLOSIVE COMPOSITIONS

CROSS-REFERENCE TO RELATED APPLICATIONS

This is a divisional application, claiming the benefit of, parent application Ser. No. 10/326,958 filed on Dec. 23, 2002, whereby the entire disclosure of which is incorporated hereby reference.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention disclosed herein relates to explosive formulations with improved combustion efficiency. More particularly, the explosive formulations of the invention are capable of maintaining a relatively high blast pressure in an oxygen poor environment, such as a tunnel or other confined spaces.

BACKGROUND OF THE INVENTION

There is a long history of studying blast explosives, reactive metals and associated metal combustion technologies. The success of the development of Solid Fuel-Air-Explosive (SFAE) has been demonstrated providing 30–40% increased internal blast over a conventional explosive. SFAE is a singular event with combined mixing and initiation of the reaction. In confined spaces, transition to full detonation is not required for enhanced blast, if the solid fuel is ignited early in the dispersion process. A series of reflective shock waves generated by the detonation mixes the hot detonation gases with metal particles and compresses the metal particles at the same time. These actions provide the chemical kinetic support to maintain a hot environment, causing more metal to ignite and burn. This late time metal combustion process produces a significant pressure rise over a longer time duration (10–50 msec). This is a phase generally referred to as after burning or late-time impulse which can occur outside of where the detonation occurred, resulting in more widespread damage.

Aluminum has been used as the metal of choice, due to high heat of combustion, cost and availability. Billets of SFAE made with Al, provide savings in volume with increased fuel mass for blast performance. However, combustion efficiency has been an issue, especially in the event that the fuel content (35–60 wt %) is high with respect to the total weight of explosive composition. Poor combustion efficiency is often observed in many of the thermobaric warhead tests, which causes the severe ineffectiveness of the weapon. This is due to the high ignition temperature, 2200 K, typically required for proper combustion of AL. During the burning of Al, heat is produced and aluminum oxide is formed. However, the burning of all the metal to completion requires maintaining the hot environment. This environment can be best maintained if it is supported chemically by the combustion of other oxidizer species (i.e. AP or nitrate ester liquid, IPN (isopropyl nitrate)) that are much easier to ignite (AP has an ignition temperature of 250 C and IPN has a low flash point of 22 C). The combustion of these additives produce the hot gases to support the burning of metal, thus 100% combustion efficiency can be obtained. Metal composites, metal and oxidizer combined granules, produced from coating of particles with a binder, can be made easily with techniques well known in the art.

Another combined approach to further improve the metal combustion efficiency is to use a more reactive metal as part of or as the entire metal fuel component. New reactive metal materials such as nano-sized aluminum to increase the reactivity, titanium and boron alloy to increase the thermal output, and magnesium/aluminum alloy to lower the ignition temperature are among the most promising approaches to increase the metal combustion efficiency. More powerful explosives such as CL-20 that are capable of raising the detonation pressure and temperature are also extremely beneficial.

There exists a need in the art for new explosive formulations with new reactive metal and metal composites to have 50–100% higher blast energy than those by the baseline composition such as Tritonal or PBX N109. Further, the new formulations coupled with new warhead designs will have the potential to form one of the most powerful thermobaric warheads, when compared to the weapon systems that currently exist.

SUMMARY OF THE INVENTION

The present invention relates to a metal composite that combines a binder, a reactive metal and an oxidizer. In an embodiment of the present invention, a plasticizer and a catalyst are also included. In yet another embodiment of the present invention, the binder includes polymers capable of coating the reactive metal and oxidizer powder. Two embodiments include methods to produce the compositions of the present invention:

(1) The coated powder forms the fuel charge through pressing, combining this fuel charge with a high explosive charge (HMX, RDX or CL-20 based PBX's) in an annular design to make up the fill for the warhead.

(2) Using metal or metal/oxidizer powders in a mixing, casting and curing process to combine with high explosive to form castable PBX's. The reactive metal contains ingredients that are intrinsically reactive with the reaction products of high explosive and oxidizer with or without the presence of high concentration of oxygen.

An embodiment of the present invention discloses a metal composite comprising about 60 to about 96 weight % of at least one reactive metal, about 4 to about 10 weight % of at least one binder and about 0 to about 36 weight % of an oxidizer. The reactive metal includes, but not limited to at least one of nano-sized metal particles, metastable mechanical alloy and any combination thereof. More specifically, the reactive metal includes, but not limited to at least one of nano-sized aluminum, nano-sized boron and nano-sized titanium, nano-sized magnesium, Al—Mg, Al—Mg—H, B—Mg, Al—B and Ti—B. The binder includes, but not limited to at least one of copolymer of vinylidine fluoride hexafluoropropylene, nitrocellulose, GAP and Zeon.

Embodiments of the present invention relating to castable compositions disclose an explosive having an annular construction. The explosive includes a cylindrical shell of solid fuel air explosive surrounding a cylindrically shaped high explosive. In other embodiments the solid fuel air explosive includes at least one of reactive metal and metal composite. The metal composite including about 60 to about 80 weight % of at least one reactive metal, about 4 to about 8 weight % of at least one binder and about 0 to about 36 weight % of an oxidizer. The reactive metal includes, but is not limited to at least one of nano-sized metal particles, metastable mechanical alloy and any combination thereof. More specifically, the reactive metal includes at least one of nano-sized aluminum, nano-sized boron and nano-sized titanium, nano-sized magnesium, Al—Mg, Al—Mg—H, B—Mg, Al—B and Ti—B, H-2 (2 μm spherical aluminum) and H-5 (5 μm spherical aluminum). The oxidizer includes, but is not limited to at least one of ammonium perchlorate, ammonium dinitramide and ammonium nitrate.

The present invention is to provide an explosive with enhanced combustion efficiently capable of sustaining a high pressure over a period of time in a confined environment with a limited oxygen supply.

The present invention is to provide an explosive capable of maintaining a relatively high pressure (30–60 psi) for up to 50 msec in an environment characterized with high rate of thermal quenching (cold air), this environment has a profound adverse effect for metal combustion, which is the main cause for combustion efficiency.

Additionally, embodiments the present invention is to provide an explosive with increased reactivity, increased thermal output and lower ignition temperatures.

Embodiments the present invention are also to provide thermobaric explosive formulations with reactive metals and metal composites which have a 100% higher blast energy than compositions such as Tritonal and PBX N109.

It is to be understood that the foregoing general description and the following detailed description are exemplary and explanatory only and are not to be viewed as being restrictive of the present invention, as claimed. These and other objects, features and advantages of the present invention will become apparent after a review of the following detailed description of the disclosed embodiments and the appended claims.

DETAILED DESCRIPTION OF THE INVENTION

Figure 1:
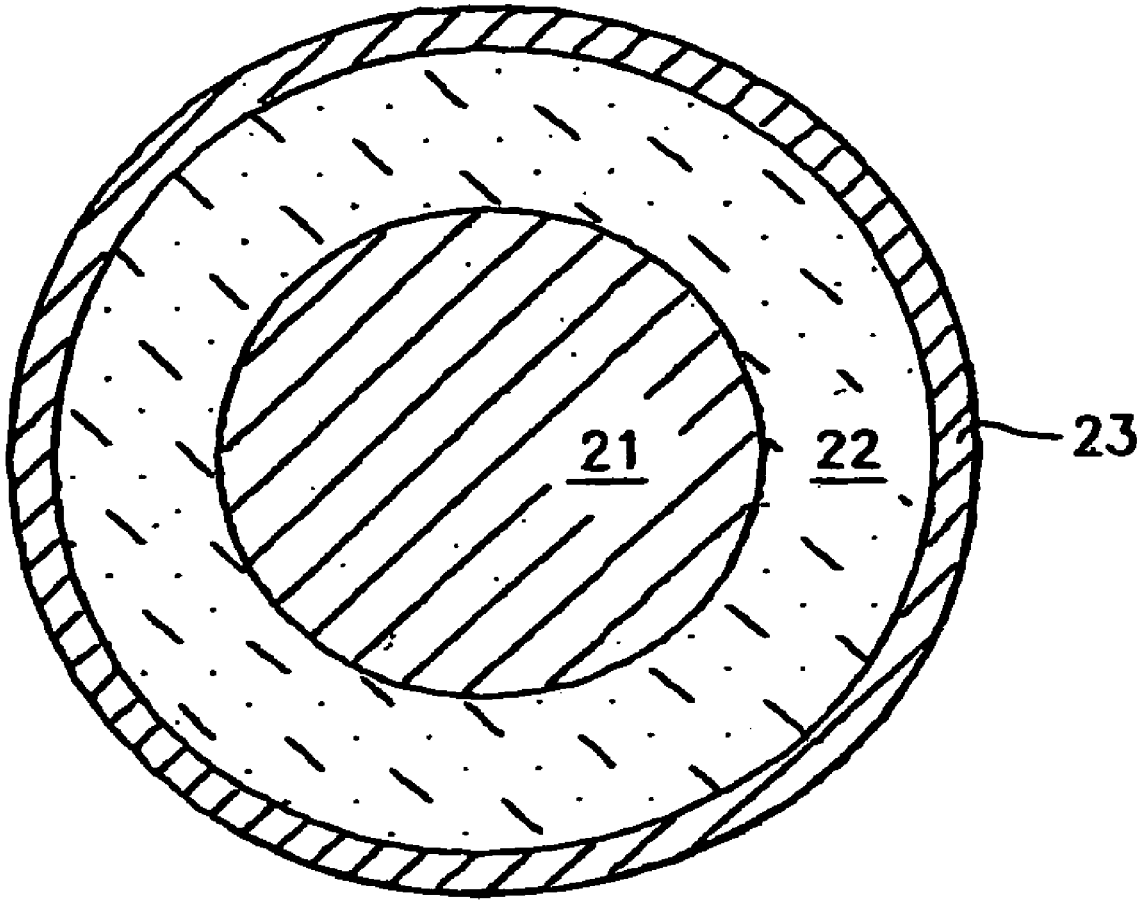
FIG. 1 is a sectional view of a typical explosive having an annular construction.

The invention disclosed herein relates to an explosive capable of enhanced combustion efficiently capable of sustaining a high pressure over a period of time in a confined environment, such as an air tight room or a cave, where oxygen may be in limited supply.

The reactive metal used in an embodiment of the present invention includes nano-sized metal particles, metastable mechanical alloys and any combination thereof. The metal fuel in these explosive formulations of the present invention incorporates nano-sized aluminum, including, for example, Alex®, boron, manganese and titanium, those having a size of about 20–500 nm. The metastable mechanical alloys include Al—Mg, Al—Mg—H, B—Mg, Al—B, Ti—B, H-2 and H-5 made from high energy milling. The metastable mechanical alloys include nano-crystalline metastable phases with particle sizes of about 1–50 μm. The reactive metal used also includes Ti, B or Mg. In another embodiment of the present invention, the reactive metal includes about 60–80 weight % of the total metal composite, or at about 74 weight %.

The thermobaric explosive formulations of the present invention incorporates high energy explosive material including, but not limited to hexa-nitro-hexa-aza-isowurtzitane (CL-20), cyclotrimethylenetrinitramine (RDX) and cyclotetramethylene tetranitramine (HMX). The powerful oxidizers, including ammonium perchlorate (AP), ammonium dinitramide (ADN), ammonium nitrate (AN) and barium nitrate are selected to be used in the metal composite or castable PBX's. Another embodiment of the present invention uses ammonium perchlorate (AP) particles, or about 11–100 μm in size. The oxidizer includes about 12–36 weight % of the total metal composites, or at about 20 weight %.

The binder includes polymers capable of coating the reactive metal and high explosive powder. The binder includes, but is not limited to at least one of copolymer of vinylidine fluoride hexafluoropropylene, including Viton®, nitrocellulose, glycidyl azide polymer (GAP) or an acrylic acid ester polymer, including Zeon®. In another embodiment of the present invention, the binder includes about 4–6 weight % of the total metal composites, or at about 4 weight % for the total metal composite. The binders used for castable PBX's include, for example, hydroxy-terminated polybutadienes (HTPB), hydroxy-terminated polycaprolactone (PCP), hydroxy-terminated polyesters, hydroxy-terminated polyethers (HTPE), Glycidyl azide polymer (GAP), trifluoroethyl-terminated poly (1-cyano-1-difluoramino)-polyethylene glycol (PCDE) and any combination thereof. Typically, 5 to 7 weight % is used for castable PBX embodiment.

In other embodiments, a plasticizer and a burn rate catalyst are added. The plasticizer includes bis-(2,2-ro-2-fluoroethyl) formal (FEFO). However, other plasticizers utilized, include energetic plasticizers selected from those compounds, which are liquids and contain energetic moieties or groups in their chemical structures. These moieties include, but not limited to nitro or nitrate ester groups, azido groups, or nitramino groups. Suitable plasticizers include TEGDN (triethyleneglycol dinitrate), or Butyl NENA (n-butyl-2-nitratoethyl-nitramine). Other suitable plasticizers include DEGDN (diethyleneglycol dinitrate), TMETN (trimethylolethane trinitrate), and BTTN (butanetriol trinitrate). These plasticizers are used independently or in combination. Other fluoramino groups including bis-(2,2-ro-2-fluoroethyl) formal (FEFO) and bis-[2,2-bis(difluoramino)-5,5-dinitro-5-fluoropentoxy]methane (SYFO) could also incorporated into the formulations. In other embodiments of the present invention, the plasticizer include about 4 weight % of the formulations.

Iron oxide ($Fe_2O_3$), nano-sized is a suitable burn rate catalyst and is optional to exotic burn rate catalysts including superfine iron oxide, chromic oxide, catocene, or carboranes. In other embodiments aluminum oxide is also used. In embodiments of the present invention, the burn rate catalyst comprises about 1 weight % of the total metal composites. Tables I and II disclose a number of the formulations of the present invention.

TABLE I

Chemical Composition of Metal Composite Coated by Various Binders

| Reactive Metal | Oxidizer | Binder | Plasticizer | Catalyst |
|---|---|---|---|---|
| 80% H-5 | 14% AP, 11 μm | 6% Viton ® | None | None |
| 60% H-5, 20% Al/Mg alloy, 28 μm | 14% AP, 11 μm | 6% Viton ® | None | None |

TABLE I-continued

Chemical Composition of Metal Composite Coated by Various Binders

| Reactive Metal | Oxidizer | Binder | Plasticizer | Catalyst |
|---|---|---|---|---|
| 80% H-5 | 12% AP, 11 μm | 6% Viton ® | None | 1% $Fe_2O_3$, nano-sized |
| 74% H-5 | 20% AP, 11 μm | 6% Viton ® | None | 1% $Fe_2O_3$, nano-sized |
| 37% Ti, 44 μm 37% B, 0.6–7 μm | 21% AP, 11 μm | 6% Nitrocellulose | None | None |
| 74% Ti—B, 20 μm | 21% AP, 11 μm | 6% Nitrocellulose | None | None |
| 74% Mg—B, 20 μm | 21% AP, 11 μm | 6% Nitrocellulose | None | None |
| 50% H-5 24% Alex ®, 0.2 μm | 20% AP, 11 μm | 5% Nitrocellulose | None | 1% $Fe_2O_3$, nano-sized |
| 50% H-5 24% Alex ®, 0.2 μm | 20% AP, 11 μm | 4% Nitrocellulose | 4% FEFO | 1% $Fe_2O_3$, nano-sized |
| 74% Alex ®, 0.2 μm | 20% AP, 11 μm | 5% Nitrocellulose | None | 1% $Fe_2O_3$, nano-sized |
| 40% Flake Al, 20% Al/Mg alloy | 36% AP, 100 μm | 4% Viton ® | None | None |

Note:
Al/Mg milled in batch MA020129-01, Ti—B milled in batch MA020317-01, and Mg—B milled in batch MA020319-01 at New Jersey Institute of Technology, Newark, New Jersey.

TABLE II

Typical Composition of Castable PBX's Containing Reactive Metal and AP Oxidizer

| | Oxidizer | Binder | High Explosive | |
|---|---|---|---|---|
| Reactive Metal | | | | Plasticizer & Catalyst |
| 20–40% | 15–35% AP, 11–100 μm | 10–15% HTPB | 30–55% HMX | 4–6% |
| Metal Composite | | | | Plasticizer |
| 40–60%* | None | 10–15% HTPB | 30–45% HMX or 30–50% HMX | None |
| 40–60%* | None | 10–15% LMA | 30–45% HMX | None |
| 30–55%* | None | 10–15% HTPB | 35–60% CL-20 | None |
| 20–24%* | 15–35% AP | 10–15% HTPB | 30–55% HMX | None |

Note:
*metal composite contains oxidizer

The novel thermobaric explosives of the present invention are spherical particles of composite material containing high explosive, oxidizer, reactive metal and binder. Plasticizer and burn rate catalyst are added to manipulate performance. A method of making the novel thermobaric explosives described herein is disclosed in U.S. Pat. No. 5,750,921 issued to Chan et al. on May 12, 1998, hereby incorporated herein by reference.

In an embodiment of the present invention, a solid fuel-air explosive annular construction is used as shown in FIG. 1. In a typical annular construction, a cylindrical shell of solid fuel air explosive (SFAE) 22 surrounds the high explosive 21. As a matter of preference, the shapes of the high explosive charge are include, but not limited to spherically or cylindrically symmetric, to provide a uniform dispersion pattern. Solid metal casings 23 are typically pressed from reactive metal powder or metal composite (listed in Table 1) as SFAE. These solid metal casings are typically machined from stock into billets, but are also manufactured by other methods including casting or forging. The SFAE is then pressed into solid billets with a density (preferred to be 80–90% TMD) applicable to the particular use. The annular construction uses flake aluminum as the reactive metal. The SFAE billets are then placed in the warhead and the explosive is cast or pressed into place. The final SFAE fuel to explosive ratio is dependent upon the size and configuration of the warhead. PBX N112 consists of 89% HMX (high explosive) and 11% LMA (lauryl methacrylate). The PBX N112/reactive metal weight ratio includes the range of about 0.66 to about 1.45, or the ratio of about 1.

Embodiments of the compositions of the present invention are formed into a unicharge. The unicharge construct uses spherical aluminum as the reactive metal. Table II discloses ranges of ingredients for the formulations of the unicharge embodiment. As noted previously, a plasticizer and/or a burn rate catalyst are added to the formulations to tailor the formulations to particular needs. Although specific binders are listed, any of the binders previously noted are also used in the formulations. Similarly, any of the oxidizers previously noted are also substituted for AP and any of the high explosives previously noted are substituted for HMX.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A solid fuel air explosive, comprising:

a first grain, wherein said first grain is a high explosive;

a second grain, wherein said second grain is a metal fuel grain, wherein said second grain substantially surrounds said first grain;

about 4.0 to about 6.0 weight % of at least one binder; and about 14.0 to about 36.0 weight % ammonium perchlorate (AP).

2. The solid fuel air explosive of claim 1, wherein the ratio of said second grain to said first grain is about 0.66 to about 1.45.

3. The solid fuel air explosive of claim 1, wherein the ratio of said second grain to said first grain is about 1.0.

4. The solid fuel air explosive of claim 1, wherein the said first grain comprises:

about 87 to about 90 weight % cyclotetramethylene tetranitramine (HMX); and about 10 to about 13 weight % binder, wherein said binder comprises at least one of hydroxy-terminated polybutadienes (HTPB), hydroxy-terminated polycaprolactone (PCP), hydroxy-terminated polyesters, hydroxy-terminated polyethers (HTPE), glycidyl azide polymer (GAP), lauryl methacrylate (LMA) and trifluoroethyl-terminated poly (1 -cyano-1-difluoramino)-polyethylene glycol (PCDE).

5. The solid fuel air explosive of claim 1, wherein said metal fuel grain is selected from the group consisting of reactive metal and metal composite.

6. The solid fuel air explosive of claim 5, wherein said reactive metal is selected from the group consisting of nano-sized metal particles, metastable mechanical alloy and any combination thereof.

7. The solid fuel air explosive composition of claim 5, wherein said reactive metal is selected from the group consisting of nano-sized aluminum, nano-sized boron and nano-sized titanium, nano-sized magnesium, Al—Mg, Al—Mg—H, B—Mg, Al—B, Ti—B, Ti, B, Mg and H-2 and H-5.

8. The solid fuel air explosive composition of claim 6, wherein said nano-sized metal particles have an average particle size of about 200 nm to about 500 nm.

* * * * *